United States Patent [19]

Richardson

[11] Patent Number: 4,782,899

[45] **Date of Patent: * Nov. 8, 1988**

[54] MEASURING OIL SATURATION WITH GASEOUS OIL TRACERS

[75] Inventor: Edwin A. Richardson, Houston, Tex.

[73] Assignee: Shell Oil Company, Houston, Tex.

[ * ] Notice: The portion of the term of this patent subsequent to Mar. 2, 2003 has been disclaimed.

[21] Appl. No.: 919,101

[22] Filed: Oct. 15, 1986

Related U.S. Application Data

[63] Continuation-in-part of Ser. No. 800,849, Nov. 22, 1985, Pat. No. 4,646,832.

[51] Int. Cl.[4] ..... E21B 47/00; E21B 49/00; G01N 33/24

[52] U.S. Cl. ..... 166/252; 166/300; 436/27; 436/29

[58] Field of Search ..... 436/27–33, 436/56; 166/250, 252, 270, 273, 274, 300, 307, 308

[56] References Cited

U.S. PATENT DOCUMENTS

| | | | |
|---|---|---|---|
| 3,532,165 | 10/1970 | Raifsnider | 166/270 |
| 3,623,842 | 11/1971 | Deans | 436/27 |
| 3,751,226 | 8/1973 | Hesse et al. | 436/27 |
| 3,801,281 | 4/1974 | Thompson et al. | 436/33 |
| 3,847,548 | 11/1974 | Keller et al. | 436/27 |
| 3,856,468 | 12/1974 | Keller | 436/27 |
| 3,990,298 | 11/1976 | Deans | 166/252 X |
| 3,993,131 | 11/1976 | Riedel | 436/27 |
| 4,099,565 | 7/1978 | Sheely et al. | 166/252 |
| 4,122,896 | 10/1978 | Scheuerman et al. | 166/307 X |
| 4,168,746 | 9/1979 | Sheely | 436/27 |
| 4,646,832 | 3/1987 | Richardson | 436/29 X |

FOREIGN PATENT DOCUMENTS

| | | | |
|---|---|---|---|
| 594807 | 3/1960 | Canada | 436/27 |

*Primary Examiner*—Barry S. Richman
*Assistant Examiner*—Robert J. Hill, Jr.

[57] ABSTRACT

The oil saturation within a subterranean reservoir is determined by injecting water containing dissolved reactants which are substantially oil-insoluble and which convert the injected solution into a tracer-containing solution in which there is at least one each of oil and water tracers, with the oil tracers being gaseous, and chromatographically analyzing the patterns of the concentrations of the tracers within fluid produced from the reservoir for determining the oil saturation.

23 Claims, No Drawings

MEASURING OIL SATURATION WITH GASEOUS OIL TRACERS

RELATED APPLICATIONS

The present invention is related, as follows, to the following patent applications which each relate to measuring oil saturation within a subterranean reservoir formation, and are commonly assigned.

U.S. Pat. No. 4,646,832, by E. A. Richardson is directed to using a gaseous oil tracer comprising $CO_2$. The present application is a continuation-in-part of such application.

U.S. Pat. No. 4,617,994, by E. A. Richardson, is directed to using a reactant-induced reduction in $CO_2$ concentration as an oil tracer.

Application Ser. No. 873,558, filed June 12, 1986 by E. A. Richardson and S. L. Wellington, is directed to using $CO_2$ as an oil tracer in conjunction with a radioactive water tracer.

Application Ser. No. 873,555, filed June 12, 1986 by E. A. Richardson and S. L. Wellington, is directed to using a decrease in $CO_2$ concentration as an oil tracer in conjunction with a radioactive water tracer.

Application Ser. No. 899,685, filed Aug. 25, 1986 by E. A. Richardson and S. L. Wellington, is directed to testing a carbonate reservoir with a $CO_2$ oil tracer formed in situ from the reservoir minerals.

BACKGROUND OF THE INVENTION

The present invention relates to determining the relative concentrations of oil and water (i.e., oil-phase and water-phase fluids) within subterranean reservoirs by measuring a chromatographic separation of tracers having distinctly different partitioning coefficients in the oil and water phase fluids in the reservoir. More particularly, the present invention relates to improving a process for making such a determination by injecting an aqueous solution of reactants which are substantially insoluble in oil but react within the reservoir to convert the injected solution to an aqueous solution containing a substantially oil-insoluble water tracer and a gaseous oil tracer which partitions between oil and water phase fluids.

In 1969 a method for determining the relative amounts of oil and water fluid phases within a subterranean reservoir by injecting an aqueous carrier fluid containing a reactant capable of forming within the formation at least two tracers which have different partitioning coefficients between the carrier fluid and the oil (as exemplified by such tracers formed by hydrolyzing ethyl acetate), and measuring a chromatographically-induced separation between the tracers, was described in U.S. Pat. No. 3,623,842. U.S. Pat. No. 3,751,226 by R. J. Hesse and R. F. Farmer relates to improving such a process by injecting a solution in which the tracer forming reactant is a hydrolyzable beta-keto ester such as ethylacetolacetate. U.S. Pat. No. 3,847,548 relates to improving such a process by injecting carrier fluid containing tracers which partition differently with respect to temperature changes and injecting that fluid at a temperature different from the reservoir temperature. U.S. Pat. No. 3,856,468 relates to improving such a process by injecting carrier fluid containing both a precursor which forms a tracer material that partitions between the fluid phases and a tracer material which s inert and substantially completely dissolved in the mobile phase. U.S. Pat. No. 3,990,298 relates to improving such a process by injecting a carrier fluid containing a plurality of precursors each of which forms a tracer which has a distinctive partition coefficient with at least one mobile fluid phase within the reservoir. U.S. Pat. Nos. 4,099,565 and 4,168,746 relate to uses of such a fluid saturation determining process for evaluating the effectiveness of a design process for recovering oil.

SUMMARY OF THE INVENTION

The present invention relates to determining the concentration of oil phase fluid within a subterranean reservoir. An aqueous solution containing solutes which remain substantially completely dissolved in the injected solution but react within the reservoir to convert the injected solution into a tracer-containing solution which contains a water tracer that remains substantially completely dissolved in the water-phase and an oil tracer which is gaseous, is substantially unreactive with the oil, and partitions between the oil-phase and the water-phase of the fluid in the reservoir, is injected into the reservoir. The tracer-containing solution is displaced within the reservoir. Fluid containing the oil and water tracers is produced. Measurements are made, relative to the volume of produced fluid, of the extent of the chromatographically-induced separation between the oil and water tracers and a determination is made of the concentration of oil-phase fluid which corresponds to the measured extent of separation between the tracers.

In effect, the present invention comprises an improved process for forming a tracer-containing solution at a selected location within a subterranean reservoir formation. The tracer-containing solution contains oil and water tracers for measuring the saturation of oil within the reservoir by measuring the extent to which the tracers are separated when the tracer-containing solution is displaced within the reservoir.

The present improvement is based on two key steps. The solution injected into the reservoir to reactively form the oil tracer contains dissolved reactants which are substantially completely insoluble in oil and the oil tracer which is formed within the reservoir comprises a gaseous material which is both partitioned between the oil and water phase fluids within the reservoir and is substantially unreactive with the oil.

DESCRIPTION OF THE INVENTION

It appears that in conventional reservoir testing operations that use chromatographically separated tracers, the only tracer-forming reactants which have been successfully used have been hydrolyzable lower alkyl carboxylic acid esters such as those described in U.S. Pat. No. 3,623,842, or analogous beta-ketoalkyl carboxylic acid esters. Such esters provide an unreacted ester comprising a significantly oil-soluble oil tracer which is partitioned between the water and oil and a water tracer such as alcohol (possibly supplemented by at least one added water tracer) which is substantially completely dissolved in the water phase. Such prior processes have received wide industry acceptance as a "single well tracer method" and more than a hundred jobs have been done. But, in general, the dependence upon organic esters has limited the use of the method to reservoirs having relatively low temperatures.

In typical prior processes the organic ester hydrolyses step must not be too fast since it is undesirable for the alcohol to be produced during the placement step and also, some unreacted ester must remain after the soak period since it is the oil tracer. At the end of the soak period, fluid containing the tracers is produced back to the wellbore. The amount of chromatographic separation between the tracers is measured and used to calculate the oil saturation.

If the reservoir temperature is above about 200° F., the hydrolysis rate of most, if not all, known esters is so fast that the above requirements cannot be met. Therefore, the prior processes have been limited to reservoirs of about 200° F. or less.

The present process removes this limitation and other limitations of the prior processes by using different tracers and different means of in situ generation of the oil tracer. In the present process, the oil phase fluid tracer is a gas that is significantly soluble in oil and is unreactive with oil. That gas is generated in situ, substantially, if not completely, during the soak period. It is generated by reactants which are substantially completely water-soluble and oil-insoluble. Those reactants are transported through the reservoir as fast and as far as the aqueous solution is transported.

Applicants have discovered that the amounts of oil and water tracers used in the process of the present invention can be as small as merely detectable trace amounts. The amounts of the tracers can range from as little as 0.001 to 1 mole per liter. The capability of utilizing trace amounts avoids the need for special disposal treatments for toxic materials and allows the use of oil-tracer-forming reactant compounds having a relatively low solubility in water. The water tracer can be preformed and thus can be a compound selected for its stability at the temperature of the reservoir being tested. Applicant has found that a variety of gaseous oil tracers partition into an oil-phase fluid and are substantially unreactive with the oil, and thus can be used in the present process. Further, a variety of selectively water-soluble reactive materials can be used to form such tracers, so that the kind of reactants to be used can be correlated with the reservoir temperature in order to provide a sufficient amount of oil phase fluid tracer during a selected residence time within numerous subterranean reservoirs. For example, the reservoir can be substantially any reservoir having a temperature of about 50° to 500° F.

Prior to Applicant's discovery, it appears that it was considered unlikely that a gaseous material which was substantially unreactive with crude oil would partition between the oil and water phases within a reservoir in a manner making the gas useful as the oil tracer in a process for measuring oil saturation based on the chromatographic separation of oil and water tracers. However, field tests using $CO_2$ as an oil tracer in the manner described in the parent application, have demonstrated the capability of such a use to yield oil saturation measurements bracketed by those obtained from the same reservoir by core analysis, nuclear magnetism logging, production history, etc.

As used herein in relation to the oil phase fluid tracer, the term "gaseous" refers to a substance which remains a dissolved gas when partitioned between the oil and water phases of a fluid system at the pressure and temperature in the reservoir being tested, as well as when separated from fluids produced from the reservoir.

In the present process, the substantially complete watersolubility and oil-insolubility of the reactants dissolved in the injected fluid ensure that the distance within the reservoir at which the oil phase fluid tracer is formed is substantially equal to the distance to which the front of the aqueous phase of the reactant-containing fluid has penetrated into the reservoir. Because of this, several procedural options are available. The reactants used in the reactant-containing solution can be compounds that react to form both an oil tracer and water tracer, or the reactant-containing solution can contain a preformed material to be used as the water tracer. Alternatively, a preformed water tracer can be added to be used in conjunction with a water tracer formed by the reactants which form the oil tracer. In either mode, the components of the reactant-containing solution can be selected so that either the water tracer or the oil tracer is radioactive and emits radiation which can be utilized in detecting the arrival of the tracer.

The gaseous nature of the oil phase fluid tracer of the present process provides unobvious advantages in measuring the separation between the oil and water tracers. For example, where the well in which the test is being conducted is arranged for producing fluid from the reservoir by gas lift and/or the fluid produced from the reservoir is separated into liquid and gaseous components, the lift gas and/or separated gaseous stream can be utilized to detect the arrival of the oil tracer in a manner indicative of the extent of the chromatographically-induced separation of the oil and water tracers within the produced fluid. Where the tracer-containing liquid solution is gas-lifted from the reservoir and/or the components of the fluid produced from the reservoir are separated at the well site, the proportion of a gaseous oil phase fluid tracer which is carried along with the lift gas or the gas separated from the produced fluid is directly correlated with the total volume of the aqueous liquid solution produced from the reservoir. The capability of detecting the arrival of the gaseous oil tracer in a stream of gas makes it possible to utilize the equipment existing at the well site in the most effective manner for conducting tests of the oil saturation within the reservoir.

In general, the oil phase fluid tracer used in the present process should comprise at least one gas which (a) is a gaseous material at the pressure and temperature at which fluid is displaced within the reservoir as well as at substantially ambient conditions at the well site, (b) is capable of being reactively-generated within the reservoir formation being tested by reactants dissolved in an aqueous solution of compounds which are substantially insoluble in the reservoir oil, (c) is partitioned between the oil and water phase fluids within the reservoir being tested, and (d) is substantially unreactive with the reservoir rock and oil. Examples of such gases include carbon dioxide, nitric oxide, ammonia, hydrogen, oxygen, sulfur dioxide, etc. Particularly preferred compounds comprise carbon dioxide and nitric oxide. Particularly preferred methods of producing carbon dioxide are described in those disclosures of the related patent applications listed above which relate to using reactants that are substantially completely oil-insoluble.

In general, particularly suitable reactions by which the exemplified oil tracers can be produced in accordance with this invention include the following:

Carbon Dioxide: Using an aqueous solution of a halocarboxylic acid salt, such as sodium chloroacetic acid, and a carbonic acid salt, such as sodium bicarbonate, $$ClCH_2COO^- + HCO_3^- \rightarrow CO_2 + HOCH_2COO^- + Cl^-.$$

Nitric Oxide: Using an aqueous solution of a salt of nitrous acid, such as sodium nitrite, (preferably, with the solution being substantially free of oxygen) and, preferably with pH buffering compounds for providing an initial injected fluid pH of about 4 to 8 (which preferred pH is relatively higher when the reservoir temperature is relatively higher)

$$3NO_2^- + 2H^+ \rightarrow 2NO + NO_3^- + H_2O.$$

Ammonia and $CO_2$: Using an aqueous solution of urea and, preferably, pH buffering compounds for maintaining a relatively constant pH, $$CO(NH_2)_2 + 2H_2O \rightarrow CO_2 + 2NH_3 + H_2O \leftarrow H\text{-}CO_3^- + NH_4^+ + NH_3$$

Hydrogen: Using an aqueous solution of a salt of hypophosphorous acid and, preferably, a catalyst for its auto-decomposition reaction, such as $$2H_2PO_2^- \rightarrow H_2 + 2HPO_3^- \rightarrow H_2 + 2PO_4^-.$$

Oxyen: Using an aqueous solution of a selectively water-soluble peroxide having a suitable rate of decomposition at the reservoir temperature, such as benzoyl peroxide, $$2(C_6H_5CO)_2O_2 \rightarrow 2(C_6H_5CO)_2O + O_2.$$

Nitrogen: Using an aqueous solution of compounds containing nitrite and ammonium ions such as ammonium nitrite, preferably including reaction rate controlling compounds such as those described in U.S. Pat. No. 4,178,993 by E. A. Richardson and R. F. Scheuerman, $$(NO_2)^- + (NH_4)^+ \rightarrow N_2 + 2H_2O.$$

Sulfur Dioxide: Using Benzoyl peroxide and Hydrogen Sulfide $$(C_6H_5CO)_2O_2 + H_2S \rightarrow SO_2 + 2C_6H_5COOH$$

In general, the present invention is suited for use in substantially any of the situations and for any of the purposes suited for an application of the previously known processes for measuring oil saturations in reservoir formations on the basis of chromatographic separations between tracers of oil phase and water phase fluids displaced within reservoirs.

Radioactively tagged water tracers can suitably be used in conjunction with, or in place of, selectively water soluble byproducts, such as acid anions of various ones of the oil-tracer-generating reaction processes. A radioactively tagged water tracer can be substantially any selectively water-soluble compound which emits detectable rays, such as alpha, beta, gamma or X-rays, etc. Suitable examples include tritiated water, water solutions containing cobalt-57 or -60 cobaltushexacyanide (usually the potassium salt) hexacyanocobaltate or $I^{125}$ salts (e.g. $NaI^{125}$). When an X-ray or low energy gamma ray emitter is used, i.e., cobalt-57, a solid scintillation counter such as $NaI(T_1)$ can be attached directly to the wellhead or production fluid flow lines for detecting the arrival of the water tracer.

In general, the aqueous solution containing the reactive solutes for forming the tracer-containing solution in which there is an oil tracer or both the oil and water tracers in accordance with the present process can comprise substantially any aqueous liquid which is compatible with those reactants and with the water in the reservoir being tested. The use of water produced from the reservoir being tested is particularly suitable. In general, it is desirable to buffer the reactant-containing solution to initially have a pH substantially equalling that of the reservoir water and to adjust its salinity to one capable of maintaining substantially the existing equilibrium between the reservoir water and minerals in the reservoir rocks.

The patterns of the concentrations with amounts of fluid produced from the reservoir being tested (and/or concentrations with time, where the production rate is substantially constant) can be measured by currently known and available chemical and/or radioactive analytical methods and apparatus. It is a distinctive advantage of the present process that known and available relatively simple procedures, such as radiation counting, infra-red, ultra-violet, biochemical, titrometric and/or thermometric analyses, etc., can be utilized to measure all or part of the data needed for determining the chromatographic separation between the gaseous oil tracer partitioned between the oil and water in the reservoir and the in situ-generated, or other, water tracer dissolved substantially completely in the water phase of the produced fluid. The gaseous phase of the oil tracer provides the advantage of being able to detect the arrival of that tracer by monitoring lift gas or separator gas streams, etc. The outflowing volumes of such streams can be correlated with those of the produced aqueous liquid stream by procedures known in the art.

What is claimed is:

1. In a process in which a solution containing oil and water tracers is formed within a subterranean reservoir formation for determining the saturation of oil phase fluid within that formation by measuring the extent to which the tracers are chromatographically separated when the tracer-containing solution is flowed within the formation, the improvement comprising:

injecting into the reservoir an aqueous solution containing solutes which are substantially compeltely insoluble in reservoir oil;

including among said solutes (a) compounds which react within the reservoir to form at least one gaseous oil tracer which partitions between oil and water phases of fluid in the reservoir and is substantially unreactive with oil, and (b) at least one compound which is, or becomes, a water soluble water tracer which is substantially completely immiscible in oil phase fluid within the reservoir; and flowing the injected aqueous solution into a selected location within the reservoir in which the saturation of oil phase fluid is to be measured and allowing said tracer forming reaction to occur in that location to form the solution containing oil and water tracers.

2. A process for determining oil saturation within a reservoir, penetrated by at least one well, comprising:

injecting into the reservoir an aqueous solution containing solutes which remain substantially completely dissolved in the aqueous solution but react within the reservoir to form a gaseous oil tracer which is unreactive with oil and partitions between oil and water phases within the reservoir and a water tracer that remains substantially dissolved in the water phase within the reservoir;

displacing the aqueous solution within the reservoir;

allowing the solutes in the aqueous solution to react and form the oil and water tracers;

producing fluid containing the tracers from the reservoir; and determining the oil saturation within the reservoir using the produced fluid and chromatographic principles.

3. The process of claim 2 wherein a water tracer is injected into the reservoir with the injected solution.

4. A process for determining oil saturation within a reservoir, penetrated by at least one well, comprising:

injecting into the reservoir an aqueous solution containing solutes and a water tracer which remain substantially completely dissolved in the aqueous solution but wherein the solutes react within the reservoir to form a gaseous oil tracer which is unreactive with oil and partitions between oil and water phases within the reservoir;

displacing the aqueous solution within the reservoir;

allowing the solutes in the aqueous solution to react and form the gaseous oil tracer;

producing fluid containing the tracers from the reservoir; and determining the oil saturation within the reservoir using the produced fluid and chromatographic principles.

5. The process of claim 2 or 4 wherein the gaseous oil tracer is carbon dioxide.

6. The process of claim 2 or 4 wherein the gaseous oil tracer is nitric oxide.

7. The process of claim 2 or 4 wherein the gaseous oil tracer is ammonia.

8. The process of claim 2 or 4 wherein the gaseous oil tracer is hydrogen.

9. The process of claim 2 or 4 wherein the gaseous oil tracer is oxygen.

10. The process of claim 2 or 4 wherein the gaseous oil tracer is nitrogen.

11. The process of claim 2 or 4 wherein the gaseous oil tracer is sulfur dioxide.

12. A process for determining oil saturation within a reservoir, penetrated by at least one well, comprising:

injecting into the reservoir an aqueous solution containing solutes which remain substantially completely dissolved in the aqueous solution but engage in an oxidation-reduction reaction within the reservoir to form a gaseous oil tracer which is unreactive with oil and partitions between oil and water phases within the reservoir and a water tracer that remains substantially dissolved in the water phase within the reservoir;

displacing the aqueous solution within the reservoir;

allowing the solutes in the aqueous solution to react and form the oil and water tracers;

producing fluid containing the tracers from the reservoir; and determining the oil saturation within the reservoir using the produced fluid and chromatographic principles.

13. The process of claim 12 wherein a water tracer is injected into the reservoir with the injected solution.

14. A process for determining oil saturation within a reservoir, penetrated by at least one well, comprising:

injecting into the reservoir an aqueous solution containing solutes and a water tracer which remain substantially completely dissolved in the aqueous solution but wherein the solutes engage in an oxidation-reduction reaction within the reservoir to form a gaseous oil tracer which is unreactive with oil and partitions between oil and water phases within the reservoir;

displacing the aqueous solution within the reservoir;

allowing the solutes in the aqueous solution to react and form the gaseous oil tracer;

producing fluid containing the tracers from the reservoir; and determining the oil saturation within the reservoir using the produced fluid and chromatographic principles.

15. The process of claim 12 or 14 wherein the gaseous oil tracer is nitric oxide.

16. The process of claim 12 or 14 wherein the gaseous oil tracer is ammonia.

17. The process of claim 12 or 14 wherein the gaseous oil tracer is hydrogen.

18. The process of claim 12 or 14 wherein the gaseous oil tracer is oxygen.

19. The process of claim 12 or 14 wherein the gaseous oil tracer is nitrogen.

20. The process of claim 12 or 14 wherein the gaseous oil tracer is sulfur dioxide.

21. A process for determining the concentration of oil phase fluid within a subterranean reservoir, comprising:

injecting into the reservoir an aqueous solution containing solutes which remain substantially completely dissolved in the injected solution but react within the reservoir to convert the injected solution into a tracer-containing solution which contains a water tracer that remains substantially dissolved in water phase fluid in the reservoir and an oil tracer which is gaseous, is unreactive with oil, and partitions between oil phase and water phase fluids within the reservoir;

displacing the aqueous solution within the reservoir;

allowing the aqueous solution to convert to its corresponding tracer-containing solution;

producing fluid containing the tracers from the reservoir;

within the produced fluid, measuring the extent of any chromatographically induced separation between arrivals of said tracers; and determining the concentration of oil phase fluid within the reservoir that corresponds to the measured extent of separation between the tracers.

22. The process of claim 21 wherein a water tracer is injected into the reservoir with the injected solution.

23. A process for determining residual oil saturation within a reservoir, penetrated by at least one well, comprising:

injecting into the reservoir an aqueous solution containing solutes and a water tracer which remain substantially completely dissolved in the aqueous solution but wherein the solutes react within the reservoir to form a gaseous oil tracer which is unreactive with oil and partitions between oil and water phases within the reservoir;

displacing the aqueous solution within the reservoir;

allowing the solutes in the aqueous solution to react and form the gaseous oil tracer;

producing fluid containing the tracers from the reservoir;

analyzing the produced fluid to determine the concentrations of the oil and water tracers therein;

determining the chromatographic separation between the oil and water tracers using the concentrations of oil and water tracers in the produced fluid; and determining the residual oil saturation within the reservoir using the chromatographic separation of the oil and water tracers.

* * * * *